United States Patent [19]

Meyer-Haake

[11] 4,217,848

[45] Aug. 19, 1980

[54] FLOATING GAS LIQUEFACTION INSTALLATION

[75] Inventor: Gerhard D. Meyer-Haake, Hamburg, Fed. Rep. of Germany

[73] Assignee: Marine Service GmbH, Hamburg, Fed. Rep. of Germany

[21] Appl. No.: 830,888

[22] Filed: Sep. 6, 1977

[30] Foreign Application Priority Data

Sep. 11, 1976 [DE] Fed. Rep. of Germany ..... 2641040

[51] Int. Cl.[2] ..... B63B 21/52; B63B 35/40

[52] U.S. Cl. ..... 114/264; 405/196; 405/210; 405/221

[58] Field of Search ..... 62/36, 9, 55; 114/264, 114/265, 266, 270, 258, 125, 121, 65 A, 256, 74 A, 74 T; 61/86, 87, 88, 89, 101, 104; 405/196, 210, 221; 9/8 P; 220/216, 218

[56] References Cited

U.S. PATENT DOCUMENTS

| | | | |
|---|---|---|---|
| 2,889,795 | 6/1959 | Parks | 114/265 |
| 2,910,834 | 11/1959 | Knapp | 61/87 |
| 3,474,749 | 10/1969 | Williamson | 114/264 |
| 3,766,583 | 10/1973 | Phelps | 114/264 |
| 3,880,102 | 4/1975 | Biewer | 114/264 |
| 4,067,080 | 1/1978 | Sylverst | 114/74 T X |

*Primary Examiner*—Douglas C. Butler
*Attorney, Agent, or Firm*—Fleit & Jacobson

[57] ABSTRACT

A floating gas liquefaction installation having a liquefaction unit and a sealed, thermally insulated tank space. The liquefaction unit is associated with a first independently floating unit and the tank space is constructed in a second independently floating unit. The two units, one of which exhibits high stability and the other of which exhibits a relatively lower stability, are associated with each other so that they respond together to wind and wave action. In one embodiment the units are fixedly connected to each other and in a second embodiment relative movement between the two units is possible.

17 Claims, 11 Drawing Figures

FLOATING GAS LIQUEFACTION INSTALLATION

BACKGROUND OF THE INVENTION

The great increase in energy prices which arose on the basis of political developments in recent years makes it imperative that a search be mounted for new sources of energy which up till now have been exploited either not at all or insufficiently.

In this regard the exploitation of deposits located at sea, whose exploitation could not be justified economically in earlier times, steps to the foreground. Thus even at the present time enormous quantities of gases admixed with oil are burnt off at the various sea wells and are thus lost to any economic use.

The employment of floating installations for purification, liquefaction, and intermediate storage for subsequent shipment in tankers is necessary for many of these deposits. The use of such floating units must also be considered for deposits which are not located at sea but rather in structurally underdeveloped or climatically unfavorable areas, since the construction of such technically complex systems in these countries themselves—the Near East—leads to very high costs and long construction times. Therefore it is advantageous, and this is particularly true for many discoveries at sea which are not of lasting productivity, that a floating system can be moved after the exhaustion of a discovery from there to another site.

Floating installations in which the liquefaction unit and the tank space are combined in one unit are already known. A Norwegian shipyard which builds LNG/LPG tankers, for example, has publicized a project in which three parts, whose construction roughly corresponds to sections of the middle of a LNG tanker, are combined in one unit. This is done in such a way that two sections, which contain the tank space, are placed together with their long axes parallel to each other while a third section, which supports the actual machine installation, is arranged transverse to these at one end and is firmly assembled to the other two.

Another known project provides for the use of a large pontoon with tanks arranged underneath which at the same time serve as pontoons. These tanks are shaped basically like large cylinders which taper conically at the upper end. Because of the low density of the liquified gases the tanks are very light, even when they are completely filled with LNG/LPG products.

The floating installations described up till now have certain disadvantages, partially from the practical/-nautical viewpoint or, if one should disregard this, for economic reasons arising from the high costs of construction. In reference to the first project mentioned above, the anchoring of large gas tankers along the long side of floating installations whose draught is hardly greater than that of a gas tanker in order to transfer oil becomes almost impossible with even slight wind and wave levels. When a storm arises during the loading the process must be broken off so as to not endanger the ship and the liquefaction installation.

For this reason another project has been described. Here the gas tankers are not anchored along the long side but rather float free of the floating liquefaction installation and are connected with it merely by means of a long bow line and are then loaded over the bow by means of special hose lines which float or hang in a long loading boom. In this project the liquefaction installation is built on deep pontoons as a so-called "half-diver." The tank space for the liquefied gas, whose volume should be somewhat larger than that of the gas tanker which is to be loaded, is placed in the pontoons or on a special floating unit, fully separated from the liquefaction installation. Because of the low density of the liquid gases, very expensive constructions are necessary to keep the empty or filled tank spaces at a somewhat constant depth and to achieve sufficient stability.

The task of developing a floating gas liquefaction installation, including tank space, which in spite of lowered production expenditures in comparison with the above-described arrangements is characterized by improved stability in all loading conditions and to a great extent avoids the above-mentioned disadvantages underlies the invention.

SUMMARY OF THE INVENTION

The invention proceeds from a floating gas liquefaction installation with sealed, thermally insulated tank space, whereby the actual gas liquefaction unit is located on and/cr in a first independently floating unit and the tank space is located in a second independently floating unit. According to the invention the second member is joined to the first member at an oscillating unit, whereby one member possesses high stability and the other an in comparison much lower stability. The installation according to the invention therefore consists of two units which are combined in such a way that they react as a unit to wind and sea motion and only jointly express inclinations to movement. It is preferable that the first unit, which bears the liquefaction installation, have a high stability. It is further provided according to the invention that the first unit is constructed as a ring surrounding the second unit.

The draught of one unit is preferably alterable independently of that of the other. This is particularly so in regard to the draught of the tank space, which must be adjustable or correctable because of the varying level of storage. A connection which permits the free vertical movement of the two units in respect to each other is used for this purpose. The level of the unit supporting the actual liquefaction installation, which is preferably a ring-shaped island resting on floating columns, can also be adjusted for wave or weather reasons by means of greater or lesser flooding of the ballast tanks.

Because of their respective particular functions and the thereby conditioned shape and form, the two units have very different stability properties. Viewed in isolation, the machine platform which supports the actual liquefaction installation has a high stability and correspondingly a short, hard roll period; on the other hand the unit containing the tank space has a low stability and weak, slow, and deep rolling movements. By means of the coupling provided for by the invention the two units necessarily support each other; the tendency of one unit to roll with the period which is characteristic of it is suppressed by the corresponding tendency of the other unit. The tank, which reacts in a very weak fashion in terms of stability, functions because of its mass somewhat like a roll gyroscope and thus forces the machine platform to undertake calmer, dampened, and slowed movements. For its part the machine platform supports the tank and keeps it from roll amplitudes which are too large.

Since both units are equipped with water ballast tanks, this opposing play of forces can be influenced and adapted to any wave and wind conditions. The stability values of the two units for themselves and thus the common roll period as well can be adjusted by increasing or lowering the ballast in the tank unit and in the machine unit. In this way it becomes possible to oppose the greatest possible damping effect to the wave and wind conditions existing at any time.

Further advantages and characteristics of the invention can be seen from the claims as well as from the subsequent description and the diagrams, in which the invention is explained and presented through examples.

BRIEF DESCRIPTION OF THE DRAWING

The following list describes what is shown in each diagram.

DESCRIPTION OF THE PREFERRED EMBODIMENTS

Figure 1:
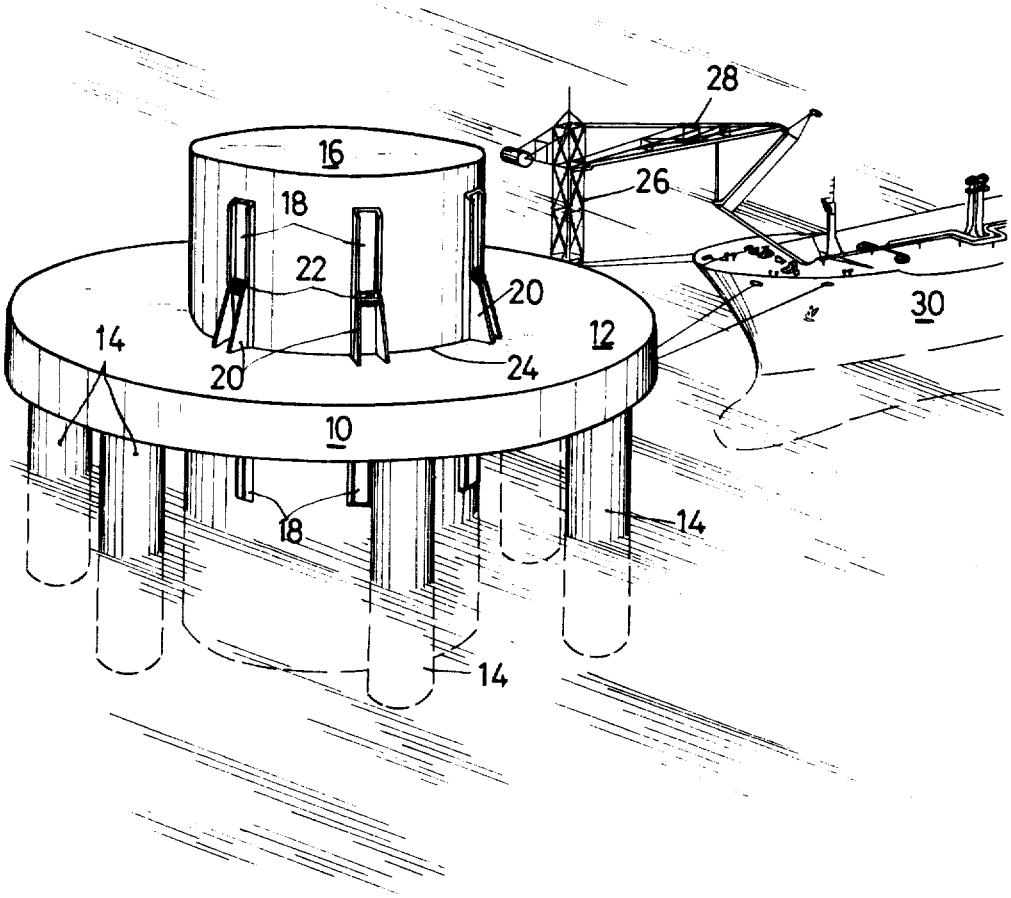
FIG. 1 a simplified diagrammatic view of an installation according to the invention, FIG. 2 a likewise simplified rendering of a vertical cross-section through an installation according to the invention.

A floating gas liquefaction installation 10, FIG. 1, consists according to the invention of a ring-shaped first unit 12, which rests as a floating island on several columns or legs 14 which contain flotation and ballast tanks. The first unit 12 surrounds the second unit 16 which contains the tank space, this unit being basically a large, vertically standing cylinder. The cylinder 16 is supported by a section 24, which is in circular in the illustrated embodiments, of the ring-shaped first unit 12 in such a way that both units oscillate as a unit with the motion of the sea and in the case of wind stress.

The tank part formed by the floating unit 16 will change its draught when filled with liquid gas in accordance with the extent to which it is filled and the density of the liquid gas. With light gases it is possible to compensate for the alteration in trim by pumping out ballast water and thus to keep the tank part at a constant draught regardless of the extent to which it is filled. In this case it can be firmly attached to the ring platform of the machine part.

With heavy gases, for which total weight compensation would require ballast spaces which are too large, it is provided that the two units 12 and 16 can be shifted vertically against each other, so that the machine platform thus retains its normal level above the water line while the tank part, however, can freely alter its draught according to the prevailing level of storage.

The above-mentioned oscillating unit of the two units 12 and 16 is used here.

In order that this shifting can occur, several guides 18 are provided on the circumference of the unit 16, which guides are placed at regular distances from each other and extend vertically. Massive roller springs which are placed on mounts 20 in a corresponding arrangement about the section 24 are conducted in these guides.

A derrick 26 with overhead beam 28 is located on the edge of the unit 12. A pipe connection for the transfer of products from the unit 16 containing the tank space runs over this overhead beam. The LNG/LPG tanker 30 picking up a load can remain an appropriate distance from the first unit 12 forming a floating island, which fact additionally protects the unit 16 containing the tank space.

The first unit 12, which forms a floating island which bears the actual liquefaction installation with machines, etc., is preferably made of steel. The actual ring member can as an example have an exterior diameter of 120 m. and a height of approximately 10 m., whereby the actual liquefaction installation is housed on the upper deck 32 and the two decks 34 and 36, other machinery as well as living and supply quarters housed on decks which are in a simplified way represented here as 38, 40, 42, and 44. The unit 38, e.g., can be provided with a connection 39 in order to receive gaseous products. This unit is connected by means of ducts which are not illustrated to units 40 and 44, from which the former is connected to a feed connection 48 of the tank space 50 by a pipe 46. A device 42 can be provided for control of the ballast spaces. Control cables 66 and 68 which also contain air ducts, lead for this purpose to the ballast spaces 54 and 55 as well as to one or more vibration damping areas 60 in the columns 14 which are opened on their underside at 62, whereby the motion of the sea more or less attempts to raise the level of liquid 64 and thereby compresses the volume of air above the liquid to a greater or lesser extent.

Air and water valves 70, 72 are schematically rendered on the ballast space 54, and they are also present at the spaces 55 in the appropriate construction.

Six columns 14 are here provided for one platform 12. At least the lower parts of the columns 14, which are partially constructed as ballast tanks, can be made of concrete.

The unit 16 is preferably made of concrete, whereby the lower part is constructed as heavily as possible, the upper part being light. A partition 52 is provided between the actual tank space 50 and the ballast space 54, this partition likewise consisting of concrete. For reasons of stability the ballast space is subdivided into several individual tanks whose dividing walls are used to support the partition.

Figure 2:
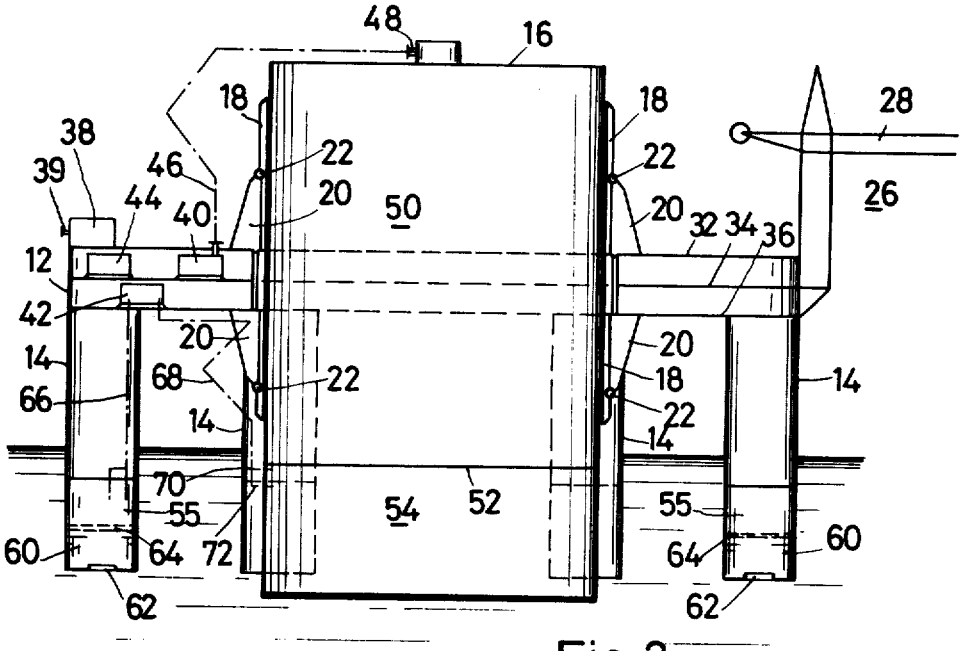

FIG. 2 shows further that the guides 18 and the rollers 22 working with them are also placed on the underside of the platform 12 in order to achieve a greater span and thus diminution of the reaction forces between the ring platform and the tank part.

At least one of the columns 14 must be detachably fixed to the unit 12 for the floatation of the tank unit 16 in the opening of the ring platform 12 (FIG. 4*a–d*). For maintenance reasons all of the columns are preferably detachable, and the ring platform is so constructed that it can float by itself, FIG. 4*a*. After appropriate ballasting the columns can be separated from the platform so that they likewise float by themselves and can be moved to the side. The ring platform 12 is provided with appropriate niches 58 and means of guidance which make possible floatation and securing and so reinforce the ring platform that it can withstand the fixed-end moments which arise with the motion of the sea.

Figure 3:
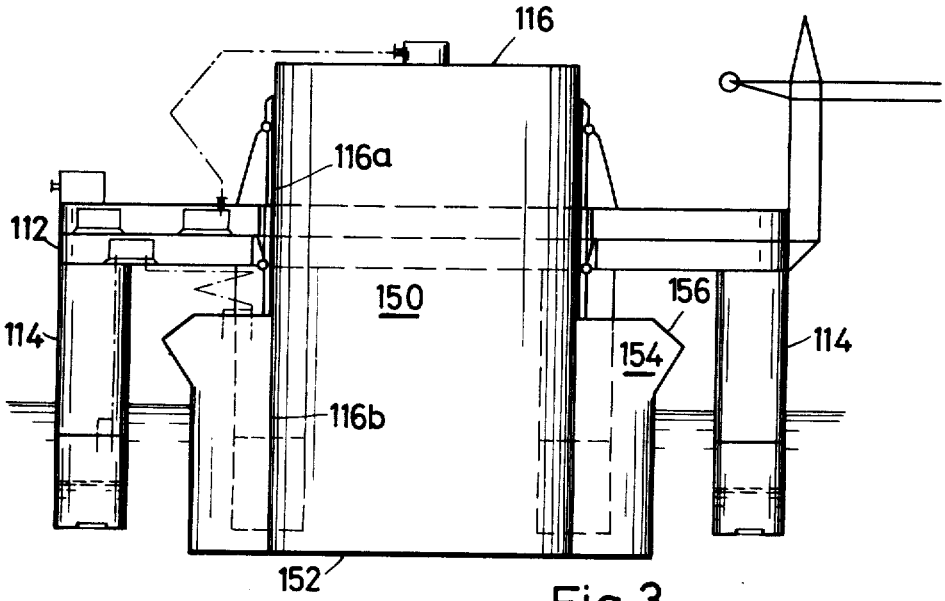
FIG. 3 a rendering of another form of construction of the invention similar to diagram 2, FIG. 4*a–d* a schematic rendering of the installation of the unit described by the invention, FIG. 5*a–d* an installation procedure especially designed for the unit described in diagram 3.
Figure 4A:
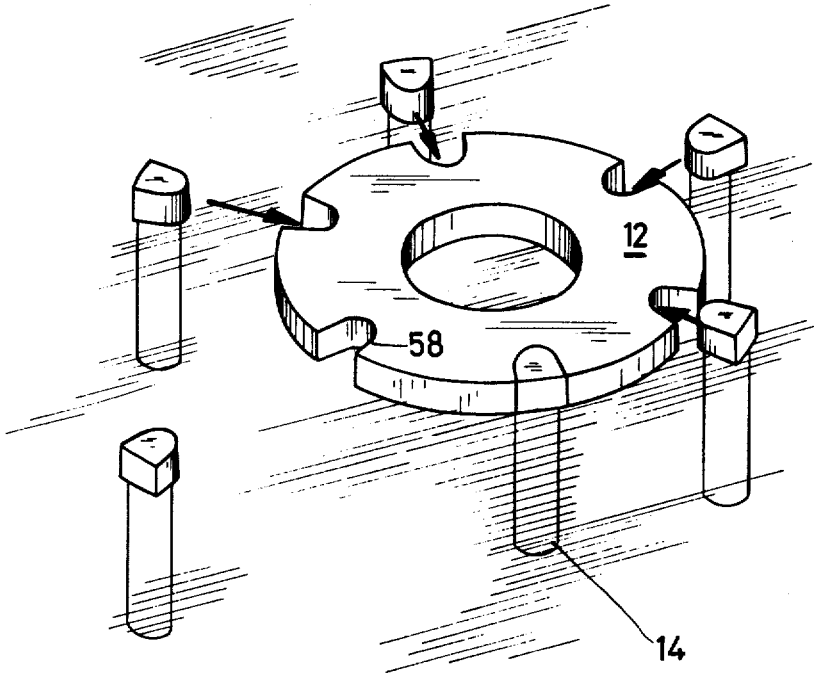
Figure 4B:
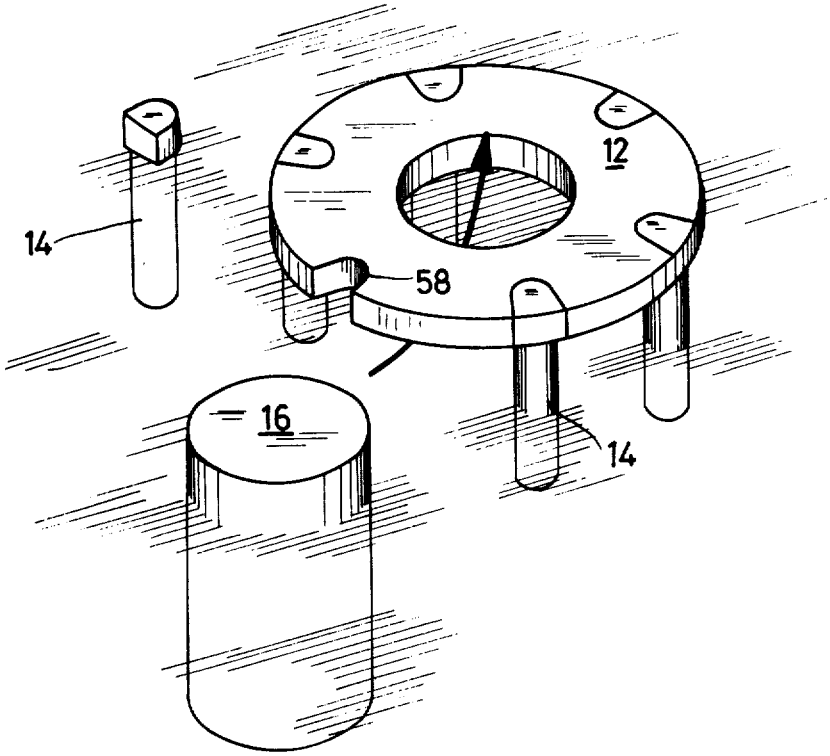
Figure 4C:
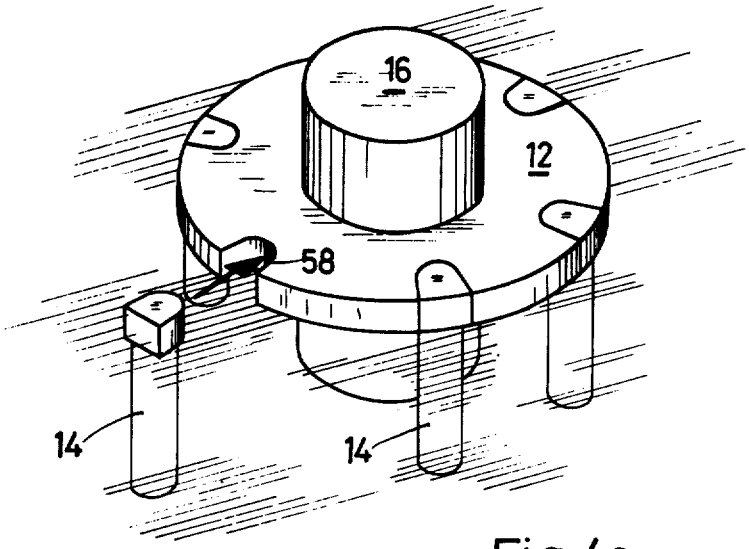
Figure 4D:
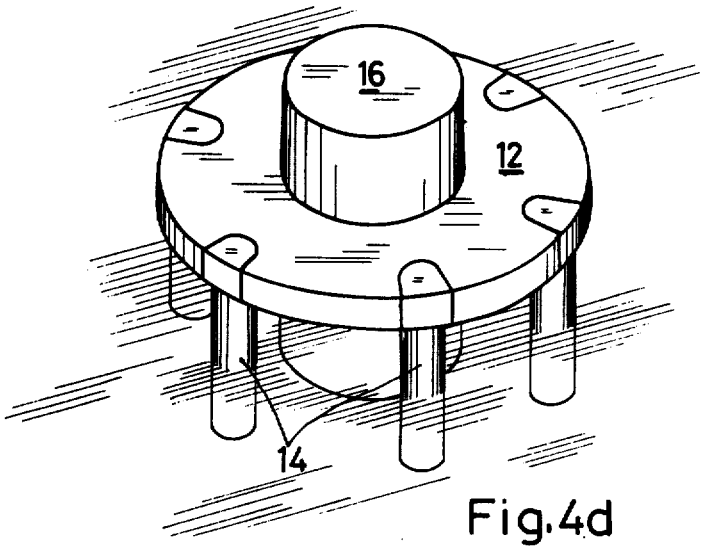
Figure 5A:
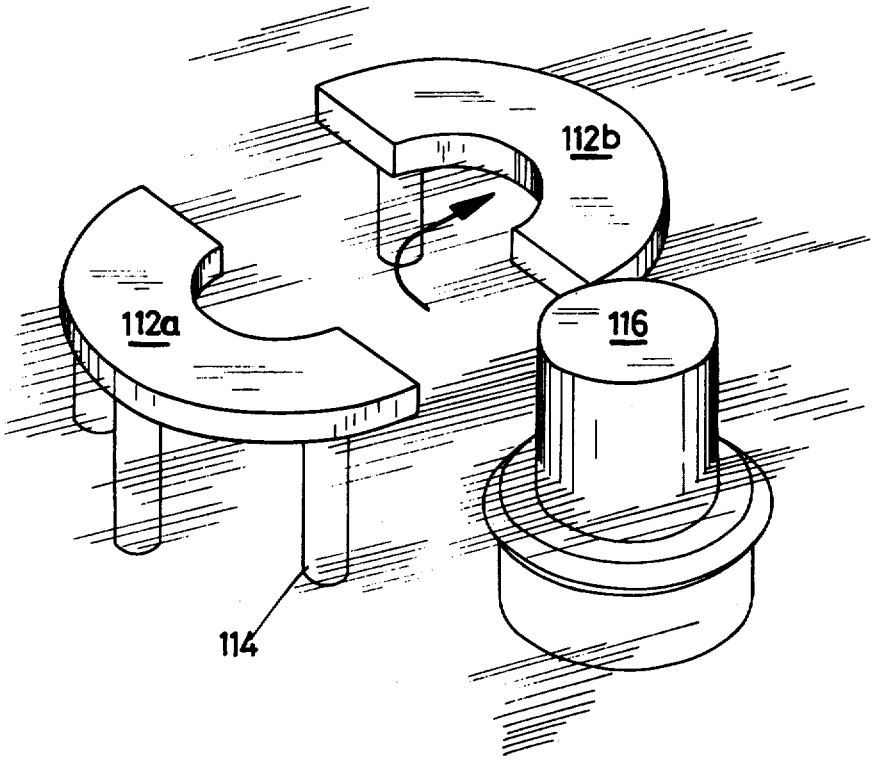
Figure 5B:
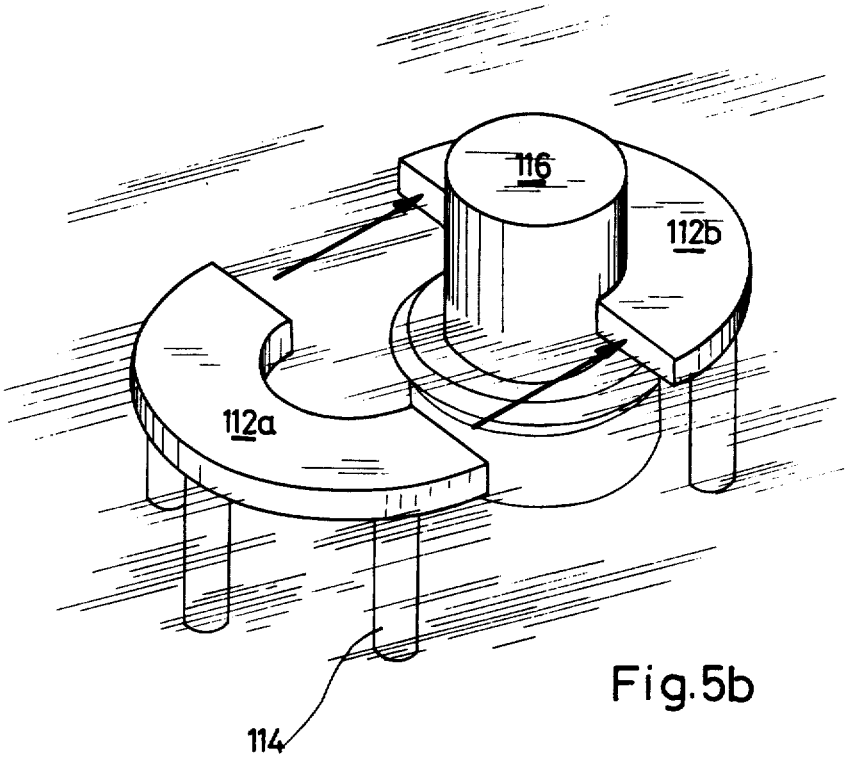
Figure 5C:
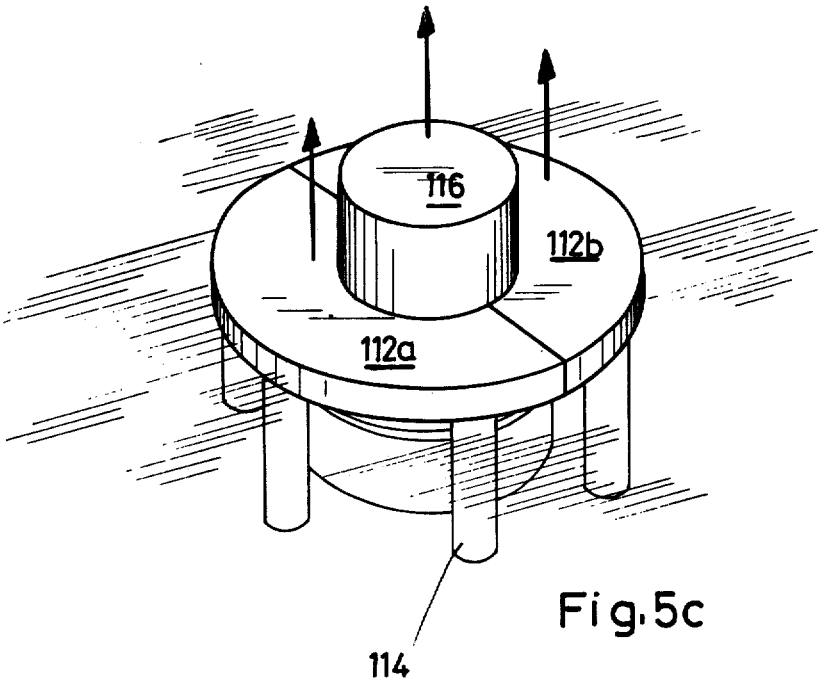
Figure 5D:
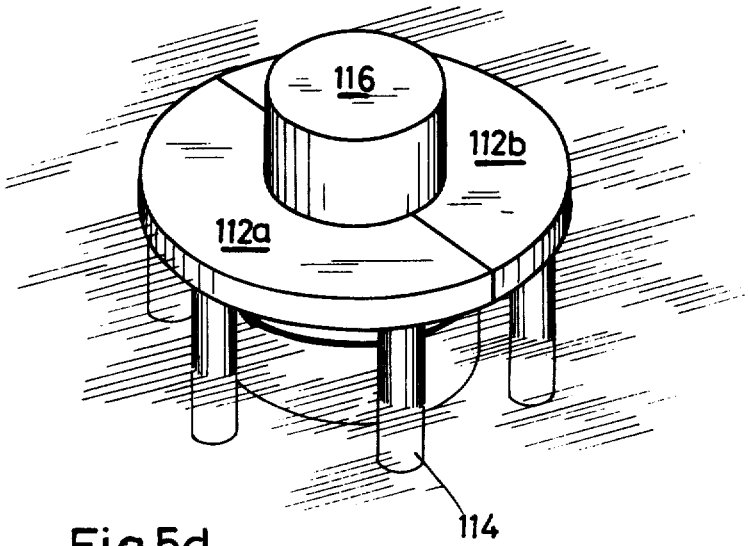

FIG. 3 shows a different form of execution from that of FIG. 1 and 2, a form whose stability properties are adapted to particular loading conditions.

In order to simplify the description the same reference symbols are always used in FIG. 3 as in FIG. 1 and 2 but are added to 100.

The basically cylindrical unit 116 is in this case constructed with a base plate 152 extending equally on all sides above its circumference and bearing the ballast tank 154. The ballast tank 154 is a cylindrical ring which surrounds outwardly the unit 116 in the lower range. The ballast tank 154, which is basically a straight cylinder, can also be replaced by an outwardly spherical tank. Instead of a completely spherical tank it is also sufficient in certain cases to construct the ballast tank 154 in its upper portion, that is in the area of the water line, with an edged beading 156.

Should the unit containing the tank space 50 or 150, respectively, be constructed completely of concrete, special precautionary measures and reinforcement are necessary, since one must presume substantial reaction forces and thus shearing and buckling stress in the span range of the two units. Instead of this the upper area 116*a* of the unit 116 can be made of steel and only the lower section 116*b* of concrete. The steel-construction element 116*a* would begin above the upper end of the ballast tank 154. The ballast tank 154 including the portion of the unit 116 enclosed by it are then made as concrete constructions. This has the advantage that the parts continually in contact with water are made of concrete. The parts of the unit 116 which are subject to pressure and shearing forces are on the other hand formed by the steel part 116*a*.

Because of the altered arrangement and construction of the ballast tank 154, the total height of the unit 116 can be substantially diminished with identical capacities as opposed to the first execution.

FIG. 5*a–d* show an assembly procedure suitable for this execution. The platform 112 consists of two basically identical parts 112*a*, 112*b*, which are firmly connected to each other only after the floatation of the tank space unit 116. The parts 112*a*, 112*b*, and the unit 116 are here at first immersed to such a level that the underside of the units 112*a*, 112*b* lie somewhat below the water surface, i.e., are slightly immersed, should additional lifting and stabilizing aids not be used. After assembly, FIGS. 5*c* and 5*d*, the normal operational immersion depth is established. The ring-shaped unit 112 can also be first produced, FIG. 4*a*, in a closed form and without the columns 114, whereby for the assembly the closed ring is divided at an appropriately prepared diameter into the parts 112*a,b*, which are later, FIG. 5*b*, put together.

I claim:

1. Floating gas liquefaction installation having a first floating unit (12) supporting a liquefaction unit and a second floating unit (16) defining a sealed, thermally insulated tank space, said first unit having relatively high stability and said second unit having a relatively lower stability, the units being associated with each other in such manner that said first unit surrounds said second unit so that the units respond together to wind and wave action, said first unit including a plurality of circumferentially spaced, downwardly-extending floating support members.

2. Installation according to claim 1, characterized in that the first unit (12) is constructed as a ring surrounding the second unit (16).

3. Installation according to claim 2, characterized in that the second unit (16) is heavier in a lower part (52) than in an upper part.

4. Installation according to claim 2, characterized in that the second unit (16) includes a lower part made of concrete.

5. Installation according to claim 2, characterized in that the second unit (16) has a basically cylindrical shape with a heavy base (52), and in that a ballast tank (54) is connected to said heavy base

6. Installation according to claim 5, characterized in that the base (52) has a larger diameter than the exterior diameter of the second unit (16) and the ballast tank (54) is constructed as a ring tank.

7. Installation according to claim 5, characterized in that the ballast tank (54) is placed under the base (52).

8. Installation according to claim 2, characterized in that the first unit (12) is comprised of two basically identical parts (112*a*, 112*b*).

9. Installation according to claim 1, characterized in that the floating support members of said first unit (12) are a plurality of columns (14) constructed as pontoons.

10. Installation according to claim 9, characterized in that the columns (14) contain floatation tanks and ballast tanks (55,60) adapted to be flooded.

11. Installation according to claim 9, characterized in that at least one of the columns (14) is adapted to be detachably connected with the first unit (12).

12. Installation according to claim 1, characterized in that said one unit of relatively high stability includes self-activating partially floodable vibration damping areas (60), adapted to be activated in dependence on the amplitude of the movement of the sea.

13. Floating gas liquefaction installation having a first unit (12) having a relatively high floating stability supporting a liquefaction unit and a second unit (16) having a floating stability less than that of said first unit and defining a sealed, thermally insulated tank space, said units being associated with each other so that the units respond together to wind and wave action, and coupling means (18, 20, 22, 24) which permit free mutual vertical shifting between said units for interconnecting the first unit (12) and the second unit (16), said coupling means comprising a plurality of sliding guides (18) positioned on one of said units and roller means (22), including shock absorbing means, positioned on the other of said units, said roller means being movable in said guides to vary the vertical relationship between said first and second units.

14. Installation according to claim 13, characterized in that the installation includes means (42,66,68) for individually adjusting the floatation height or immersion depth of each of said first and second units (12, 16).

15. Installation according to claim 13, characterized in that the roller means includes roller and the shock absorbing means comprises an elastic sleeve of the rollers (22).

16. A floating processing installation comprising:

(a) a first partially submersible, generally annular shaped floating body defining a platform and having a relatively high floating stability;

(b) a second partially submersible, substantially cylindrical floating body having an axial length greater than the axial length of said first body and defining a tank space with a closed bottom and having a relatively low floating stability, said second body being positionable inside said first body;

(c) means for interconnecting said first and said second bodies so that said bodies respond as one unit to wind and wave action; and (d) a plurality of downwardly-extending float members circumferentially spaced around said first body for supporting said first body.

17. An installation according to claim 16 wherein said means for interconnecting rigidly interconnects said first and said second bodies.

* * * * *